166-250 SR
FIP8011 XR 4,044,828
X1055W
X166/250

United Stat
Jones et al.
[11] 4,044,828
[45] Aug. 30, 1977

[54] PROCESS FOR DIRECT MEASUREMENT OF THE ORIENTATION OF HYDRAULIC FRACTURES

[75] Inventors: Arfon Harry Jones; Henri Samuel Swolfs; Sidney Joseph Green, all of Salt Lake City, Utah

[73] Assignee: Terra Tek, Inc., Salt Lake City, Utah

[21] Appl. No.: 703,091

[22] Filed: July 6, 1976

[51] Int. Cl.[2] ..... E21B 47/00; E21B 43/26

[52] U.S. Cl. ..... 166/250; 73/88 E; 166/308; 33/302

[58] Field of Search ..... 166/250, 252, 254, 308; 73/88 E, 151, 155

[56] References Cited

U.S. PATENT DOCUMENTS

| | | | |
|---|---|---|---|
| 3,153,772 | 10/1964 | Dorr | 73/88 E |
| 3,372,577 | 3/1968 | Bates et al. | 73/88 E |
| 3,402,769 | 9/1968 | Doggett et al. | 166/308 X |
| 3,427,652 | 2/1969 | Seay | 166/308 X |
| 3,427,876 | 2/1969 | Steele et al. | 73/88 E |
| 3,586,105 | 9/1971 | Johnson et al. | 166/250 |
| 3,739,871 | 6/1973 | Bailey | 166/250 X |
| 3,961,524 | 6/1976 | Cruz | 73/88 E |

*Primary Examiner*—Stephen J. Novosad
*Attorney, Agent, or Firm*—M. Reid Russell

[57] ABSTRACT

This is an invention in a method for locating the azimuthal direction of fractures induced into an underground formation adjacent to a well bore. Practicing the method of the invention involves measurement of stresses created at or near ground surface by such fracture propagation, utilizing pressure sensitive devices making up stress meters which reflect those stress changes on standard pressure gauges. Such stress meters are preferably each placed at an optimum distance from a well bore and spaced therearound, and, when a fracture is induced in the formation around the well bore, preferably by hydraulic means, said stress meters measure surface stress changes as horizontal pressure changes, which pressure change measurements can then be used to mathematically determine the direction of the fracture.

4 Claims, 6 Drawing Figures

FIG. 3

PROCESS FOR DIRECT MEASUREMENT OF THE ORIENTATION OF HYDRAULIC FRACTURES

BRIEF DESCRIPTION OF THE INVENTION

Field of the Invention

This invention relates to methods for measuring, at ground surface, the direction of fracture propagation induced in a formation around a well bore.

Setting of the Invention

Massive stimulation of natural gas wells by hydraulic and other fracturing methods holds considerable promise for recovery of additional gas from such wells located in thick, low permeability sandstone reservoirs, and the like. To achieve economic and efficient recovery from such well fracturing(2) Is the direction of fracture propagation consistent over large areas in relationship to the geologic setting of the region? (3) What is the length and height of each such fracture?

This invention proposes to answer the first question directly by providing a method for measuring, at ground surface, the redistribution of compressional forces or stresses in rock formations around a well bore as the rock at or above the pay zone thereof is being hydraulically fractured. Practicing the method of the invention provides for a direct and unambiguous measurement of the fracture propagation by sensing stress changes at or near the ground surface above the gas reservoir, which stress changes can be used as data for mathematically calculating fracture direction. Obviously, by locating the azimuthal direction of hydraulic fractures from numerous well bores within a region, it should be possible to answer question (2) as to whether the fracture propagation is consistent over large areas so as to aid in avoiding future overlapping fractures or like unnecessary fracturing.

Prior Art

Numerous methods have heretofore been developed to affect fracturing of geothermal and gas wells for recovering additional water and hydrocarbons from thick low permeability reservoirs. A sampling of such prior art includes: U.S. Pat. No. 2,813,583 and 2,914,304, which patents involve use of air, under pressure, to fracture such a well bore; and U.S. Pat. No. 3,050,119, 3,587,743, 3,020,954, 3,630,279 and 3,659,652, which patents involve packing off such a well bore and introducing a pressure medium, either liquid, air or explosive, to produce, from an expansion of the medium, fractures that extend outwardly and downwardly from within the well bore. While all these patents involve methods for producing such fracturing, no patent, or disclosure to our knowledge, involves a method like that of the present invention for plotting the direction of such fractures. Stress meters like those useful for practicing the method of the present invention and their use for measuring earth stress changes are not new, but such measuring equipment and techniques have recently become better known for their use in predicting earthquakes. One such prior disclosure, relating to earthquake prediction, was contained in a report authored by H. S. Swolfs, C. E. Brechtel, H. R. Pratt, and W. F. Brace in an article entitled, "Stress Monitoring Systems for Earthquake Predictions", Terra Tek Report TR75-10, 1975, pp. 16. However, use of such stress measuring techniques around a well bore, at a time of fracture thereof, for determining the direction of fractures propagated in that well bore has not, to our knowledge, heretofore been attempted. Therefore, within the knowledge of the inventors there has not heretofore been known a method like that of the present invention involving monitoring surface stress changes, at a time when the area surrounding a well bore in hydraulically fractured for determining the direction of such fracturing.

SUMMARY OF THE INVENTION

It is the principal object of the present invention to provide a method for determining fracture direction, in a rock formation containing a well bore, when the well bore is fractured, involving sensing ground stress changes at the surface at the time of the fracture providing stress change measurements useful for determining mathematically the direction of such fracture.

Another object is to provide, by locating stress meters used to record surface stress changes at appropriate distances from the well bore, accurate stress change data, sufficient to enable the mathematical calculation, from those stress changes, an accurate plottage of the direction of a fracture in the material surrounding a well bore.

Still another object, is to provide for the optimum placement of stress meters preferably utilized in practicing the method of the present invention, around a well bore so as to gather sufficient stress change data for locating mathematically the direction of fractures induced in the formation surrounding that well bore.

The steps involved in practicing the method for the present invention include the selection of a well bore in a natural gas producing area, or the like, located in a rock formation appropriate for hydraulic fracturing, or fracturing by like methods. Prior to effecting such fracturing, groupings of stress meters consisting of 120° rosettes of three sensing devices are spaced around the wall bore. Such stress meters should be capable of accurately sensing small or slight stress changes that are transmitted through the ground.

Each such grouping of sensing devices makes up a single stress meter that is preferably installed beneath ground surface an appropriate distance from a well bore so as to provide for a faithful transmission of stress changes from fracturing the material around the well bore through the ground to the individual sensing devices. Such stress meters appropriately spaced around the well bore, should accurately sense stress changes no matter the fracture direction, with results measured by one stress meter useful for comparison with data from another. Each sensing device of a preferred stress meter individually measures stress changes in a plane normal thereto, with three sensing devices per stress meter, to provide data that can be reduced mathematically to horizontal stress component measurements for location of the direction of the well bore fracture.

Stress meters useful for practicing the method of the present invention, should be, in addition to being sufficiently sensitive as mentioned hereinabove, insensitive to temperature changes and other enviromental conditions that make difficult the precise measurements of earth strain, tilt, and other stress related variables. Practicing the method of the present invention, using such stress meters, makes unnecessary the calculation or consideration of the particular types of materials and physical properties of the material wherein the well bore to be fractured is located.

Other objects and steps of the present invention will be further elaborated on herein and will become more apparent from the following detailed description, taken together with the accompanied drawings.

THE DRAWINGS

FIG. 1, is a finite-element model of a well bore formed in a strata having both fixed and free boundaries;

FIG. 2, a finite-element calculation of horizontal surface stress changes as a function of horizontal distance from the well bore of FIG. 1, showing different fracture pressures as parameters that could occur during fracturing thereof;

FIG. 3, a top plan view looking down at a well bore having three groupings of stress meters preferrably utilized in practicing the method of the invention located therearound;

FIG. 4, a pottage of axial stresses sensed by one of the stress meters of FIG. 3;

FIG. 5, a graph of a plane strain stress distribution for both model and theoretical fractures, the graph relating stress distribution to horizontal distance from the well bore, and;

FIG. 6, a profile perspective view of a preferred sensing device for inclusion as part of a preferred stress meter, the sensing device shown installed below ground surface and is included to illustrate the working principles thereof when used in practicing the method of the present invention.

DETAILED DESCRIPTION

Figure 1:
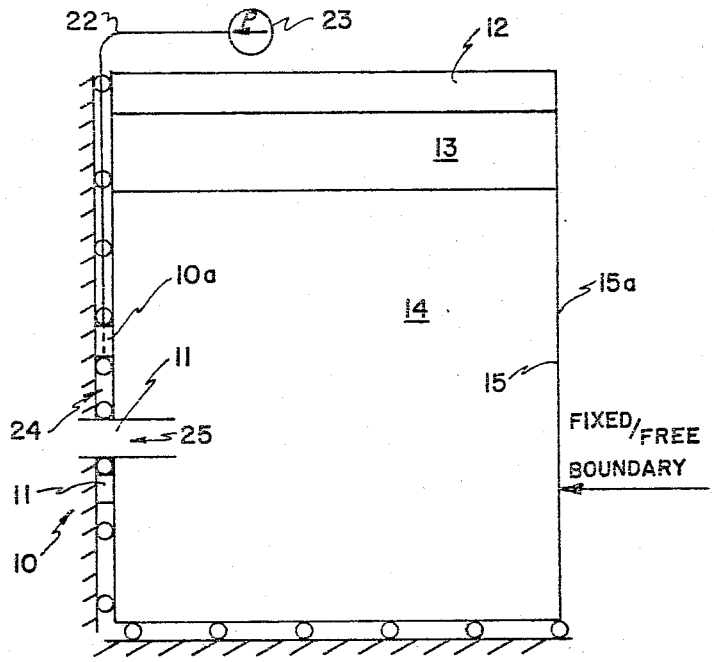

Referring now to the drawings:

In FIG. 1, is shown as a sectional underground view, a well bore 10 that should be taken as having been formed in a low permeability, sandstone reservoir or the like, wherein a hydrocarbon or hot water source is found. Assuming that the well bore 10 depicts a single well within a field of wells sunk into such rock formation, it is desired to fracture, preferably by hydraulic methods, that well bore at approximately a depth of 2400 meters so as to increase the flow into said well bore. The object of the practice of the method of the present invention, therefore, is to locate the direction of a fracture induced in the formation around such well bore by taking surface stress change measurements during the time well bore 10 is fractured. Such measurement thereafter being useful to mathematically plot such fracture direction within a field so as to avoid overlapping fracturing, and like problems.

Practicing the method of the present invention will be described herein in relation to one well bore 10 only but should be taken as being the same method as would be practiced on all well bores within a field where fracturing is to be undertaken.

Practicing the method of the invention assumes a plurality of producing natural gas wells, or like wells, all located in a low permeability sandstone formation, or the like, wherein it is determined additional production can be obtained by fracturing the formation materials around individual well bore. Well bore 10 of FIG. 1 represents one such well bore selected to be subjected to fracturing of the formation there surrounding. In preparation for such fracturing the well bore 10 is packed off at 10*a* and 11, as shown in FIG. 1, above and below the preferred depth. The packing should, of course, be understood to be strong enough to hold fast at pressures below the fracture opening pressure for the formation. A number of commonly known packing materials and techniques could be employed to provide such packing to include RTTS Packer, commercially available from Halliburton Company, Duncan, Oklahoma, or a like packing manufacturing company. Of course, if the desired fracture point of the formation is determined to be proximate to the well bore 10 bottom, then packing 11 could be dispensed with.

Prior to installation of packing 10*a* , a high pressure hose 22, FIG. 1, is installed through packing 10*a*, which hose 22 is connected above the gound surface to pump 23, that is shown in schematic in FIG. 1. To effect a desired well bore 10 fracturing, a liquid under pressure is preferably pumped from pump 23, through hose 22, and into cavity 24, fracturing the well bore at 25, as shown in FIG. 1, to a height of 150 meters.

Figure 3:
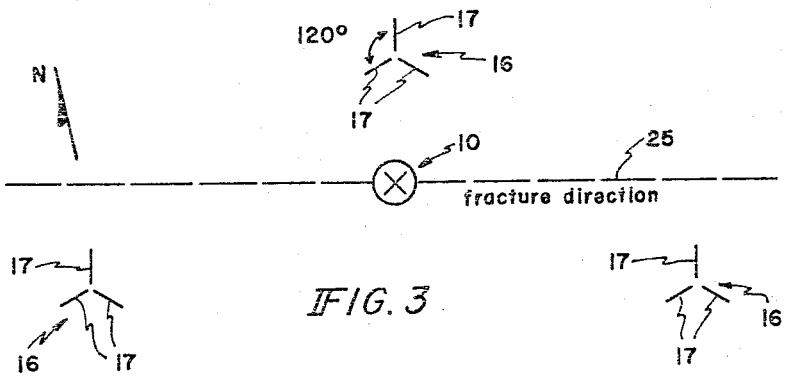

Recognizing that the pumping of a liquid under pressure into cavity 24 will cause a fracture 25, it is desirable to know the direction of that fracture which fracture direction is the object of the practice of the method of the present invention. Therefore, prior to introduction of the fluid under pressure into cavity 24, preferred stress meters 16, that consist individually of three sensing devices 17 arranged in a 120° rosette pattern, as shown in FIG. 3, are arranged around the well bore 10. While there may exist other stress meters sufficiently sensitive to record such surface stress changes from fracturing of material surrounding well bore 10, the present disclosure will be confined to a description of stress meter 16 only which will be described in detail later herein, though it should be understood that, other sensing devices which would be sufficiently sensitive to record such surface stress changes could be substituted for stress meters 16 without departing from the scope of the present disclosure.

The individual sensing device 17, shown in FIG. 6, will be described later herein relating to its construction and functioning. Assuming stress meters 16 are arranged around well bore 10, as is shown in FIG. 3 when the formation around the well bore is fractured the meters will record present surface stress changes, with the individual stress meters 16 each being capable of sensing and recording such changes to a resolution to 0.1 millibar of pressure. The stress change measurements recorded by the individual stress meters can then be resolved, as to magnitude and direction, into principal horizontal components of stress change at each stress meter location. While two such stress meters may be sufficient to provide adequate stress change measurements useful to calculate the direction of a fracture, the use of three such meters provides a redundancy of measurement data to provide a more accurate fracture direction calculation. Discussion of the actual plottage of such fracture direction, from data produced by individual stress meters 16, will be outlined later herein with respect to a model calculation, in reference to FIG. 4.

Measurement of such surface stress changes, in addition to providing data useful for plotting well bore fractures can, by comparison with measurements taken during other well bore fractures, be used to calculate the overall tectonic or structural setting of the region. By such analysis, optimum future well spacing can be calculated so as to maximize yield efficiency in the development of the field.

Figure 2:
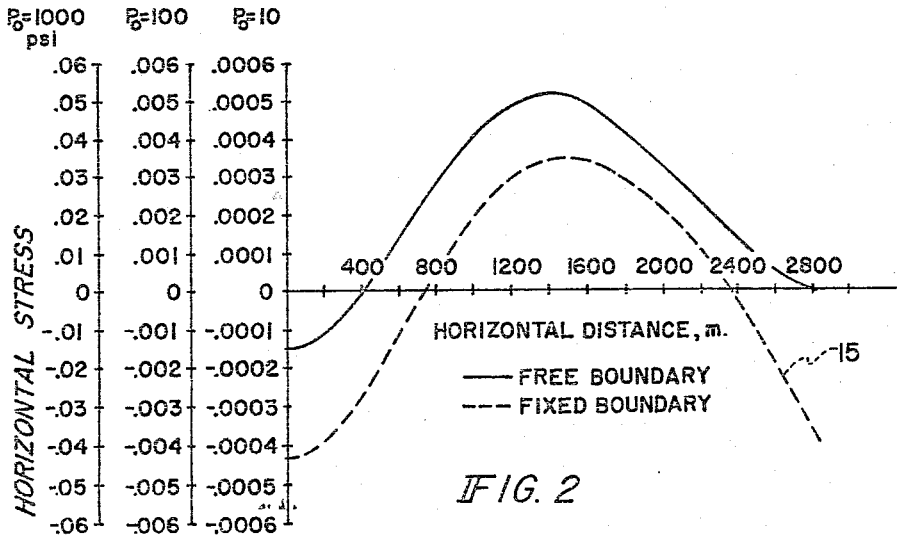

To further describe the method of the present invention, in relation to a theoretical model, it should be assumed that: the fracture 25 in well bore 10, is some 152 meters in height; occurs at a depth of 2400 meters;

is preferably induced by hydraulic methods; and occurs in a formation consisting of three layers of material: A top layer 12 thereof, that has a modulus of 34 k-bars; a next lower layer 13, that has a modulus of 69 k-bars; and a bottom layer 14, that has a modulus of 345 k-bars. The three layers 12, 13, and 14, are intended to simulate the effect of a soft overlying layer, an intermediate layer, and a high modulus layer, wherein a pay zone is located, which formation is typically of one found in a gas bearing formation. The material is further assumed to have a fixed boundary, shown in FIG. 1, at 15, and a free boundary 15*a* that exists on a vertical plane parallel to and at a distance of 2,800 meters from the plane of the well bore 10. FIG. 1 therefore, shows a finite element idealization of a well bore wherein a hydraulic fracture has been induced, with the graph of FIG. 2 showing the result of calculations for both free and fixed boundary conditions for various pressure conditions experienced on the fracture face. The horizontal stress component, thereof is plotted along the ground surface as a function of the horizontal distance normal to the plane of the fracture. The solid and broken line plots, shown in the graph of FIG. 2, relate to the fixed and free boundary material conditions, the lines showing that an ideal positioning of the sensing meters 16, would be at 1500 meters from the well bore 10, but that positioning should not be less than 400 or greater than 2800 meters from the well bore. As per the vertical component of the graph of FIG. 2, the best distance for efficient transmital of stress changes through the ground is at 1500 meters and that between 400 to 2800 meters from the well bore is acceptable for stress meter positioning.

Shown in the graph of FIG. 2, the fixed boundary material passes approximately 250 millibars (0.35 psi) and the free boundary passing approximately 350 millibars (0.50 psi) at a distance of 1500 meters from well bore 10, which pressure transmission occurs at a face pressure of 1000 psi. A face pressure of 1000 psi has been found in practice to be approximately that pressure produced during hydrofracturing of a material similar to the material assumed herein to contain well bore 10.

The individual preferred sensing device 17, as will be described in detail later herein, is capable of sensing pressure changes of an order of magnitude of as low as 1 millibar, and, therefore, surface stress changes of 300 millibars are some 300 times greater than the maximum pressures that are capable of being sensed by the individual sensing device 17. Likewise, for the free boundary condition, whereat pressures of approximately 500 millibars are calculated to be present the sensing device 17 is, of course, also effective in sensing stress changes.

Figure 4:
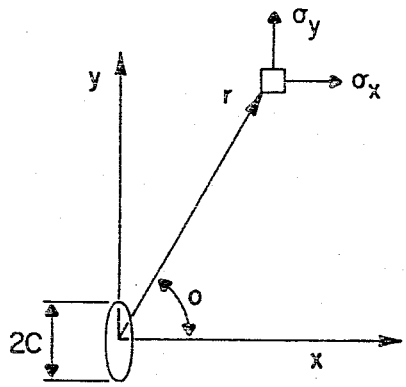
Figure 5:
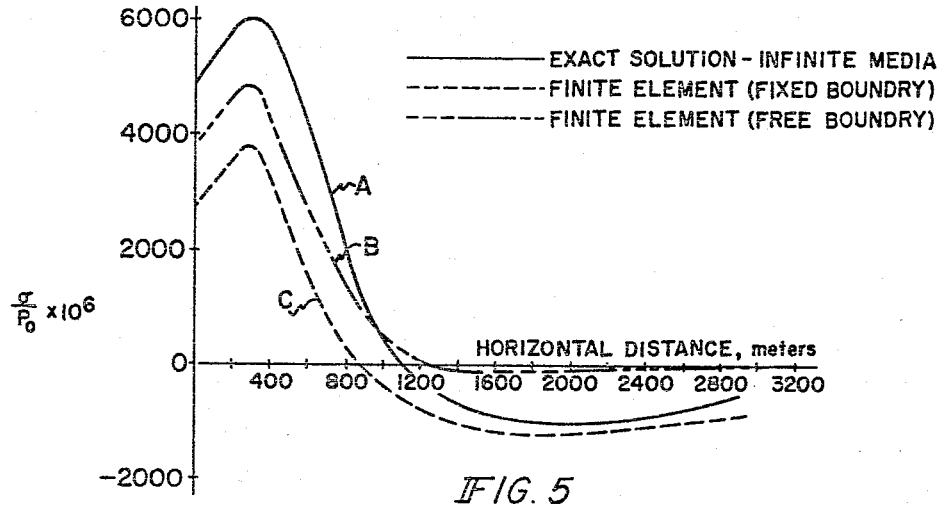

In FIG. 4 is shown a mathematical model for checking the above recited calculated results for the interior of the model. In that model: 2 C equals fracture height; $\theta$ equals the angle between $r$ and $x$; $x$ equals the horizontal axis that is normal to the fracture; $y$ equals the vertical axis; $r$ equals the radius vector indicating direction and distance from the point of the fracture; and $\sigma x$ and $\sigma y$ equal, respectively, horizontal and vertical stresses at the distance $r$ from the fracture. FIG. 4 represents a theoretical result for a fracture produced in an infinite medium that is subjected to internal pressure wherein a fracture, shown as an elipse, is normal to the $x,y$, and $r$ planes. Using the model a solution for a stress distribution at some point away from the crack center is given by the formula:

$$o_x = P_o\left[\frac{r}{\sqrt{r_1 r_2}}\cos\left(\theta - \frac{\theta_1}{2} - \frac{\theta_2}{2}\right) - 1 - \frac{r}{c}\left(\frac{c^2}{r_1 r_2}\right)\frac{3}{2}\cos\theta\cos\left(\frac{3}{2}(\theta_1 + \theta_2)\right)\right]$$

where:

$r = \sqrt{x^2 + y^2}$ $\theta = \tan^{-1}(y/x)$ $r_1 = \sqrt{x^2 + (y-c)^2}$ $r_2 = \sqrt{x^2 + (y+c)^2}$ $\theta_1 = \tan^{-1}[(y-c)/x]$ $\theta_2 = \tan^{-1}[(y+c)/x]$ FIG. 5. shows a plattage using the above formula of curve A, for an exact solution in infinite media, with curves B and C, being plottages of finite elements (fixed and free boundaries respectively). The graph illustrates a good agreement between the theoretical and calculated solutions, with differences therebetween being due to the multilayered model and the finite boundary condition assumed in the finite element calculation. From FIG. 5 an important observation can be made that the fixed boundary solution is very close to the exact solution at distances from 1600 meters to 2800 meters from the well bore. This result suggests that the plot of the fixed boundary solution for surface stress changes, shown in FIG. 2, is probably the more correct.

As per the above, stress changes on the order of from 0.3 to 0.6 psi can be expected to occur at the surface of the ground as a result of a hydraulic fracturing of the material around well bore 10 at a depth of approximately 2400 meters, as has been earlier herein described with respect to FIGS. 1 and 2. To assure a faithful transfer of stress changes reaching the ground surface from the underlining rock structure, the individual sensing devices 17 of each stress meter 16 should be placed in the soil at a depth of not more than 4 meters below the surface. Some compaction should be made but not so much as to damage the device.

Figure 6:
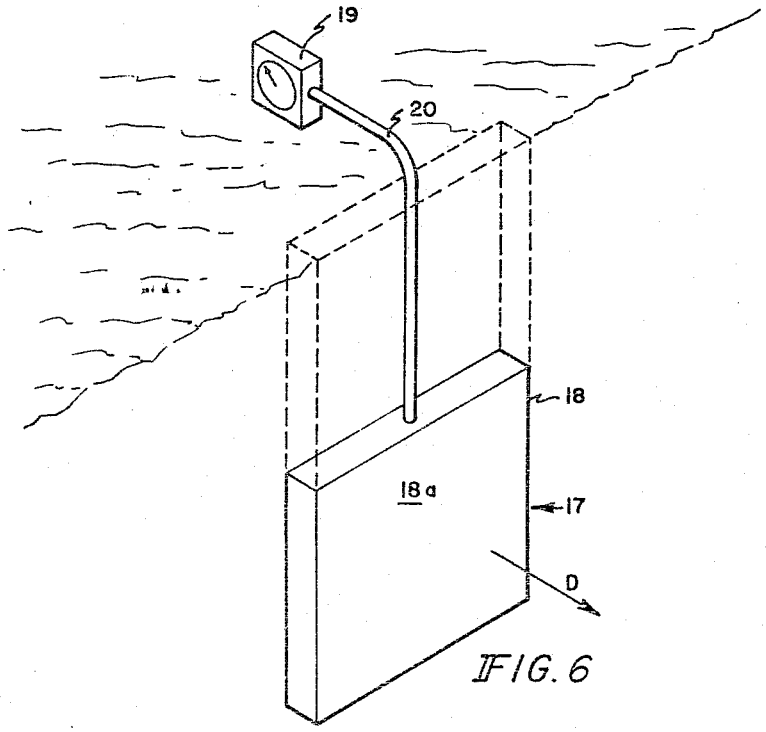

FIG. 6, shows a pictorial representation of an individual sensing device 17, shown to resemble a bladder that should be taken as being of one of three such sensing devices making up stress meter 16. As outlined earlier herein, three such stress meters are preferrably arranged, as per FIG. 3 around the well bore 10, though, as was mentioned earlier herein, two such stress meters 16, spaced appropriately around the well bore would be sufficient to provide sufficient data to calculate fracture direction.

The individual sensing device 17, as shown in FIG. 6, preferably consists of an outer shell 18 and contains a pressurized working fluid. A pressure gauge 19 is connected through a tube 20 to sense changes in fluid pressure within the interior of the sensing device. After installation of the sensing device 17 in the ground, which installation is shown as broken lines in FIG. 6, any stress changes transmitted through the ground to the sensing device will cause a movement of the working fluid therein, effecting, thereby, a change in pressure that will be detected on pressure gauge 19. Such changes in pressure, of course, occurs at the time the material around well bore 10 is fractured, with such stress changes being sensed in a direction perpendicular to the plane of the sensing device as, indicated by arrow D, which arrow extends normal to front and rear walls 18a the outer shell 18 of sensing device 17. Ideally, the slenderness ratio of the cavity of the sensing device 17 should be so small, in comparison to its length, that any pressure changes sensed in a plane parallel to the planes of the outer shell front and rear walls 18a of the sensing device outer shell 18 can be ignored. Assuming that good transmission of stress changes is present perpendicular to the planes of the outer shell front and rear walls 18a, and that the earth around the sensing device is elastic and isotropic, a faithful transmission of stress changes into the described device should occur.

As stated hereinbefore, the preferred slenderness ratio of the outer shell 18, i.e. the shell width or length divided by the thickness, should be much greater than unity. Therefore, because the volume of fluid within the outer shell 18 is a function of pressure and temperature, and as the temperature of the fluid in the sensing device 17 can be assumed to be constant and therefore, the fluid volume is a function of the fluid pressure. Changes in the fluid volume in the shell equate, therefore, to pressure changes in the horizontal and vertical axes of the sensing device, which axes are in the plane of the outer shell, and pressure changes in the other horizontal axis, which axis is normal to the outer shell front and rear walls 18a. However, as the fluid modulus is relatively small, due to the large slenderness ratio, the pressure changes in the plane of the outer shell can be ignored as they are, in comparison, very small, and, therefore, only those pressure changes in the horizontal axis normal to the outer shell as indicated by arrow D in FIG. 6, which horizontal axis is the same as axis $x$ shown in FIG. 4, will closely equal stress changes transmitted to the sensing device 17 through the ground.

Referring to FIG. 3, and to the graph of FIG. 2, the preferred individual stress meter 16 for practicing the method of the present invention, as has been mentioned earlier herein, consists of the three sensing devices 17 that are positioned in a 120° rosette pattern. While the described stress meter 16 is preferred for practicing the method of the invention, another stress meter capable of sensing pressure changes of a magnitude similar to those produced during fracturing of material surrounding a well bore, could, of course, be used. Such stress meter as per the curves of FIG. 2, for both free and fixed boundary conditions optimally should be located at approximately a distance of some 1500 meters from the well bore 10 for best sensing of stress changes transmitted through the ground. However, depending upon the sensitivity of such sensing meter used in practicing the method of the invention, such sensing meter could be located any convenient distance between 400 and 2800 meters from the well bore to still produce sufficient stress change data for locating fracture direction.

While the above described method is that preferred in practicing the invention, it is to be understood that modifications of the described steps or substitution of other apparatus could be made for those described without departing from the scope or spirit of the invention.

We claim:

1. A method for directly measuring, from ground stress changes, the orientation of fractures induced into a formation surrounding a well bore comprising the steps of:

Packing off, at a desired depth, a portion of a well bore wherein fracturing of the formation surrounding said well bore will be undertaken, positioning a plurality of stress meters around said well bore, each such stress meter being capable of and arranged to sense ground surface stress changes resultant from fracturing occurring within said well bore said ground surface stress changes being resolvable, as to magnitude and direction, into principal horizontal components of stress change at each stress meter location, fracturing said material around said well bore by introducing a pressure medium within the packed off area of said well bore, recording, with said stress meters, surface stress changes resultant from fracturing the material around said well bore, resolving said ground stress changes, as to magnitude and direction, into principal horizontal components of stress change at each stress meter location, and;

determining from said resolved principal horizontal components of stress change the direction of the fracture.

2. A method as defined in claim 1, including the step of:

locating each stress meter between 400 and 2,800 meters from the well bore.

3. A method as defined in claim 1, including the step of:

positioning three stress meters around the well bore, each stress meter being capable of and arranged to sense ground surface stress changes resultant from fracturing the formation around said well bore.

4. A method as defined in claim 1, including the step of:

comparing fracture direction location data with fracture direction location data obtained from fracturing other well bores within a region to determine the geologic setting of the region.

* * * * *